US006679638B2

(12) United States Patent
Matas

(10) Patent No.: US 6,679,638 B2
(45) Date of Patent: Jan. 20, 2004

(54) UNIDIRECTIONAL MODE PRINTERS

(75) Inventor: Lluis Vinals Matas, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/766,523

(22) Filed: Jan. 19, 2001

(65) Prior Publication Data

US 2001/0009626 A1 Jul. 26, 2001

(30) Foreign Application Priority Data

Jan. 20, 2000 (EP) ..... 00101060

(51) Int. Cl.[7] ..... B41J 19/00
(52) U.S. Cl. ..... 400/319; 400/279; 400/283
(58) Field of Search ..... 400/319, 323, 400/279, 320.1, 329.2, 328, 582, 62, 283, 578; 271/266

(56) References Cited

U.S. PATENT DOCUMENTS 4,761,085 A * 8/1988 Angst et al. ..... 400/323
4,819,556 A 4/1989 Abe et al.
4,833,626 A * 5/1989 Malcolm ..... 364/519
4,976,555 A * 12/1990 Ueyama ..... 400/314.1
5,189,436 A * 2/1993 Yoshikawa ..... 346/1.1
5,351,068 A 9/1994 Moon
5,527,121 A 6/1996 Santon
5,669,721 A * 9/1997 Santon et al. ..... 400/279
5,873,663 A * 2/1999 Yokoi et al. ..... 400/279
6,000,869 A * 12/1999 Lee ..... 400/279
6,139,205 A * 10/2000 Suzuki et al. ..... 400/76
6,471,319 B1 * 10/2002 Adkins et al. ..... 347/11

FOREIGN PATENT DOCUMENTS

EP 0312324 A2 4/1989

OTHER PUBLICATIONS

Bridge, S., European Search Report, completed on May 11, 2000, in the European Patent Office in Munich for application No. EP 00 10 1060.

* cited by examiner

*Primary Examiner*—Charles H. Nolan, Jr.

(57) ABSTRACT

To save time between printing passes of a unidirectional printer, the print medium is advanced in two phases separated in time by the fast return of the carriage. The print medium advance movements coincide, at least partly, with the periods of acceleration and deceleration which immediately precede and follow a printing pass and during which the carriage is changing from printing speed to return speed or vice versa. If the total print medium advance time exceeds these acceleration and deceleration times, the extra print medium advance occurs at a single end of the carriage movement.

3 Claims, No Drawings

UNIDIRECTIONAL MODE PRINTERS

FIELD OF THE INVENTION

The present invention relates to printers capable of operating in a unidirectional mode and in particular to a method of reducing the total printing pass time of ink-jet printers and plotters by appropriate co-ordination of the paper axis and scan axis movements.

BACKGROUND OF THE INVENTION

Although movements of the print medium in the print medium (or paper) axis and movements of the printing carriage in the carriage (or scan) axis typically take only tenths of seconds, these non-printing periods add up to several seconds along a whole plot. Accordingly there is a need to optimise carriage and paper movements to decrease printing pass time and thus to increase the throughput of the printer.

In prior art printers operating in a bi-directional mode, such as those in the Hewlett-Packard DesignJet series, scan and paper axis movements during non-printing periods (i.e. when ink is not actually being applied to the paper) are performed simultaneously. This has the advantage of minimising the time between printing periods to a value equal to the greater of the duration of the scan axis movement and the duration of the paper axis movement.

Such a solution is not always achievable with unidirectional mode printers in which it may not be desirable or possible to make an advance along the paper axis while a scan axis movement of maximum return speed is being undertaken. For example, if both these movements occur simultaneously, the paper may lift off the printer platen and come into contact with the printhead in an undesired manner. In addition, more complex movement algorithms would be required to control the servos of the carriage and paper movement motors in parallel; this would require more CPU processing time which would interrupt or delay the preparation of data for the next printing pass. Moreover, a higher power consumption would be required in particular higher current peaks which would involve more expensive power components and would tend to produce more electrical interference. Accordingly, the present invention seeks to overcome the problem of optimising total printing time in such unidirectional mode printers. It seeks to achieve this by specifying an appropriate algorithm.

SUMMARY OF THE INVENTION

According to a first aspect of the present invention, there is provided a method of operating a printer in a unidirectional mode in which, at the end of a printing pass, a printing carriage is:

(i) in a first phase, decelerated from its printing speed and accelerated in the opposite direction to a return speed;

(ii) in a second phase, returned towards its start end at said return speed; and (iii) in a third phase, decelerated to zero speed and accelerated in the printing direction to its printing speed;

and during the above period an appropriate advance occurs in the print medium axis so that the next printing pass can start, characterised in that print medium advance movements are undertaken in both the first and third phases.

An advantage of the above method is that time is not wasted in unnecessarily performing scan axis movements and paper axis movements sequentially. Instead one avoids as much as possible a decelerating or accelerating scan axis movement at either end of the scan axis without an accompanying print medium axis movement.

If the print medium advance takes longer than the sum of the decelerating and accelerating scan axis movements, it is completed adjacent in time to these movements at only one end of the scan axis (i.e. directly preceding and/or directly following these movements). This ensures that the print medium advance occurs as quickly as possible, thus contributing to the improvement of throughput.

According to a second aspect of the present invention, there is provided a printer capable of operating in a unidirectional mode and comprising a printing carriage, carriage movement means for causing the carriage to move through a printing pass, decelerating the carriage at the end of a printing pass, accelerating the carriage in the opposite direction, returning the carriage towards its start end, at a substantially constant speed, decelerating the carriage at its start end and accelerating the carriage to its printing speed, and print medium advance means for advancing a print medium between printing passes, characterised in that the arrangement is such that the advance means moves the print medium during two periods separated in time by the period during which the carriage movement means is returning the carriage towards its start end at the substantially constant speed.

DETAILED DESCRIPTION OF THE INVENTION

A preferred embodiment of the present innovation will now be described by way of example only.

As the throughput requirements for unidirectional mode printers increase, improvements are required in the time needed to position the print medium and the cartridge in their correct printing disposition. Typically, printers spend some time when the machine is advancing the medium, this movement being undertaken after the last drop of ink has landed on the medium, to avoid dot placement errors. Another necessary movement is stopping the carriage after the last drop of ink has been ejected from the print head, and accelerating the carriage again, until the carriage reaches its returning speed.

Paper axis movements require slower velocities than scan (carriage) axis speeds, to avoid slippage or non-accurate media advances, compared to. Typical values are:

Paper axis mean acceleration: 1.2 $m/s^2$
Paper axis maximum velocity: 0.1 m/s
Scan axis mean acceleration: 9.3 $m/s^2$
Scan axis maximum velocity: 1.5 m/s An exemplary method according to the present invention will be explained with reference to a 91.4 cm (36 inch) printer operating with a single pass unidirectional mode printing at 63.5 cm/sec (25 ips) and returning at 152.4 cm/sec (60 ips).

Typical values of the times taken for various operations are as, follows:

Printing@25 ips: 1.5 seconds
Decelerating the carriage from 25 ips: 0.07 seconds
Accelerating the carriage to 60 ips: 0.16 seconds
Returning the carriage@60 ips: 0.46 seconds
Decelerating the carriage from 60 ips: 0.16 seconds
Accelerating the carriage to 25 ips: 0.07 seconds
A full print medium advance: 0.36 seconds, a typical full advance being 2.54 cm (1 inch)
Half a print medium advance: 0.22 seconds.

There will now be considered the time taken for an entire printing pass, that is the printing time and the time taken to return to the start position ready to start the next printing pass. If all the movements were performed sequentially, the total time taken would be 2.78 seconds, see Table 1.

TABLE 1

| Operation | Time Taken (secs) |
|---|---|
| Printing | 1.50 |
| Stopping carriage | 0.07 |
| Advancing print medium | 0.36 |
| Accelerating carriage | 0.16 |
| Returning carriage to start end | 0.46 |
| Stopping carriage | 0.16 |
| Accelerating carriage to print speed | 0.07 |
| TOTAL | 2.78 |

A prior improvement to this method of operation, involves advancing the print medium during one of the stopping and accelerating phases. Thus an improvement to 2.55 seconds can be obtained as shown in Table 2.

TABLE 2

| Operation | Time Taken (secs) |
|---|---|
| Printing | 1.50 |
| Combined operation* | 0.36 |
| Returning carriage to start end | 0.46 |
| Stopping carriage | 0.16 |
| Accelerating carriage to print speed | 0.07 |
| TOTAL | 2.55 |

The combined operation comprises stopping the carriage and accelerating the carriage and simultaneously advancing the print medium. Its duration depends upon which is the greater of:

a) the total duration of the stopping and accelerating of the carriage; or b) the duration of the advance movement of the print medium.

In the example given, it is duration b) which is the greater, and it is this value, 0.36 seconds, which occurs in the second column.

The present invention is based upon the recognition that a further reduction in time can be obtained by dividing the print medium advance into two phases, each of which occurs simultaneously with decelerating and accelerating phases of the carriage. Even though the total print medium advance time is longer because of extra acceleration and deceleration periods in the print medium axis, this is offset by performing more of, and preferably all, the print medium advance during scan axis deceleration and acceleration periods.

Thus in the example, a time of 2.42 seconds may be obtained as shown in Table 3.

TABLE 3

| Operation | Time Taken (secs) |
|---|---|
| Printing | 1.50 |
| First combined operation* | 0.23 |
| Returning carriage to start end | 0.46 |
| Second combined operation* | 0.23 |
| TOTAL | 2.42 |

The first combined operation is similar to that of Table 2, but with only half a print medium advance. Since the duration of half an advance is only 0.22 seconds, the combined duration of the decelerating and accelerating movements at the end of the scan axis is greater and it is this value, 0.23 seconds, which occurs in the second column. Similar considerations apply to the figure entered in the second column corresponding to the second combined operation.

An advantage of the above-described arrangement is that, by splitting the print medium advance into two phases before and after the first return of the carriage, the time is minimised during which only one operation is occurring, i.e. print medium advance or movement of the carriage in preparation for the next printing pass. Thus time is saved and the throughput of the printer is increased.

Various modifications may be made to the above-described arrangement. For example, where the time for half of a print medium advance is less than the time to accelerate and decelerate the carriage at one end, the print medium advance may occur at the beginning, in the middle, or at the end of the time "window" defined by the acceleration and deceleration operation. Provided they fit within the windows, the print medium advance movements do not need to have the same duration as each other.

Due to the construction of the printer, the windows at the beginning and end of the fast carriage return may have different lengths; in this case the two print medium advance movements are tailored to fit within the windows as far as possible.

In some cases, the combined duration of the two print medium advance movements exceeds the combined duration of the acceleration and deceleration phases at both ends of the carriage path. In these cases, print medium advance is undertaken throughout the acceleration and deceleration phases and the print medium advance is completed outside these phases, and preferably immediately preceding and/or following them. In preferred arrangements, the medium advance precisely matches the deceleration and acceleration phase at one end of the printer and completion of the print medium advance occurs immediately preceding and/or following the acceleration and deceleration phase at the other end of the printer. In this way, maximum print medium advance velocities are achieved to improve throughput.

It will be appreciated that the printer may be one which operates solely in the unidirectional mode or alternatively one which can be set to operate either unidirectionally or bi-directionally.

What is claimed is:

1. A method of operating a printer in a unidirectional mode in which, at the end of a printing pass, a printer carriage is:

(i) in a first phase, decelerated from its printing speed and accelerated in the opposite direction to a return speed;

(ii) in a second phase, returned towards its start end at said return speed; and (iii) in a third phase, decelerated to zero speed and accelerated in the printing direction to its printing speed;

and during the above period an appropriate advance occurs in the print medium axis so that the next printing pass can start, wherein said print medium advance movements are undertaken in both the first and third phases, and wherein no print medium advance movement is undertaken in the second phase.

2. A method according to claim 1, wherein the advance movements undertaken during each of the first and third phases are substantially equal.

3. A method according to claim 1, the combined duration of the advance movements being less than the combined duration of the first and third phases, wherein the advance movements are completed within the first and third phases.

* * * * *